US005161562A

United States Patent [19]

Wu

[11] Patent Number: 5,161,562

[45] Date of Patent: Nov. 10, 1992

[54] UMBRELLA WITH SIMPLIFIED AUTOMATIC CLOSING MECHANISM

[76] Inventor: Woh-Wen Wu, P.O. Box 55-1670, Taipei (10477), Taiwan

[21] Appl. No.: 872,931

[22] Filed: Apr. 20, 1992

[51] Int. Cl.[5] ..... A45B 25/14

[52] U.S. Cl. ..... 135/20.3; 135/24; 135/25.1; 135/23

[58] Field of Search ..... 135/20.3, 22–24, 135/25.1, 15.1, 38

[56] References Cited

U.S. PATENT DOCUMENTS

| | | | |
|---|---|---|---|
| 680,661 | 8/1901 | Hunt | 135/24 |
| 1,091,895 | 3/1914 | Schaaf | 135/24 X |
| 2,914,154 | 11/1959 | Russell | 135/20.3 X |
| 2,951,492 | 9/1960 | Small | 135/20.3 |
| 3,129,715 | 4/1964 | Militano et al. | 135/20.3 |
| 3,150,671 | 9/1964 | Frey | 135/20.3 |
| 4,928,718 | 5/1990 | Apple | 135/20.3 X |
| 4,986,294 | 1/1991 | Wu | 135/24 X |
| 4,989,625 | 2/1991 | Wu | 135/24 X |
| 5,058,613 | 10/1991 | Su et al. | 135/24 X |

FOREIGN PATENT DOCUMENTS

| | | | |
|---|---|---|---|
| 801216 | 11/1950 | Fed. Rep. of Germany . | |
| 2353967 | 5/1974 | Fed. Rep. of Germany | 135/20.3 |
| 0542146 | 4/1956 | Italy | 135/20.3 |

*Primary Examiner*—David A. Scherbel
*Assistant Examiner*—Lan Mai

[57] ABSTRACT

An umbrella includes: a central shaft having a lower tube secured on a grip and an upper tube telescopically mounted on the lower tube, a plurality of umbrella ribs pivotally secured to the central shaft for securing an umbrella cloth thereon, a plurality of rib restoring springs respectively secured on the ribs for operatively automatically closing the umbrella, which is previously opened to tension the rib restoring springs for storing their restoring spring energy, a control device having a push button transversely slidably held in a grip and a closing actuator vertically slidably held in the lower tube having a pulling rod linked to a resilient latch for operatively retracting the resilient latch for uncoupling the upper tube from the lower tube when closing the umbrella, and a rope secured between the lower tube and a lower runner of the umbrella ribs by slidably winding the rope in an upper portion of the upper tube to be operatively tensioned on the rope when opening the umbrella to have a tendency for pulling the lower runner of the umbrella ribs and the upper tube towards the lower tube as restored by the rib restoring springs for helpfully closing the umbrella automatically, thereby providing an umbrella having an automatically closing mechanism with simple construction, easy production and convenient operation.

4 Claims, 3 Drawing Sheets

UMBRELLA WITH SIMPLIFIED AUTOMATIC CLOSING MECHANISM

BACKGROUND OF THE INVENTION

Tseng Su disclosed an "one hand operated umbrella capable of self-closing in his U.S. Pat. No. 5,058,613. However, besides the protrusion (41) of the spring pawl (4), a stopper (61) must be further provided for retaining the slider (6) when opening the umbrella, thereby increasing production complexity and cost, and also increasing operation inconvenience.

German Patent No. 801216 also disclosed an umbrella with automatic closing function, having a long tensioning spring 11 slidably jacketed on the central shafts 1, 3 for producing a spring energy for automatically closing the umbrella when depressing a closing controller of the umbrella. However, when opening the umbrella of such a German patent, an extended spring 11 from his FIG. 2 should be greatly shortened and compressed to restore a spring energy, requiring a greater force for opening a closed umbrella and causing a difficulty for opening the umbrella especially by a kid or weak woman.

The present inventor has found the drawbacks of the conventional umbrella, and invented the present umbrella having simplified mechanism for automatically closing the umbrella.

SUMMARY OF THE INVENTION

The object of the present invention is to provide an umbrella including: a central shaft having a lower tube secured on a grip and an upper tube telescopically mounted on the lower tube, a plurality of umbrella ribs pivotally secured to the central shaft for securing an umbrella cloth thereon, a plurality of rib restoring springs respectively secured on the ribs for operatively automatically closing the umbrella, which is previously opened to tension the rib restoring springs for storing their restoring spring energy, a control device having a push button transversely slidably held in the grip and a closing actuator vertically slidably held in the lower tube having a pulling rod linked to a resilient latch for operatively retracting the resilient latch for uncoupling the upper tube from the lower tube when closing the umbrella, and a rope secured between the lower tube and a lower runner of the umbrella ribs by slidably winding the rope in an upper portion of the upper tube to be operatively tensioned on the rope when opening the umbrella to have a tendency for pulling the lower runner of the umbrella ribs and the upper tube towards the lower tube as restored by the rib restoring springs for helpfully closing the umbrella automatically, thereby providing an umbrella having an automatically closing mechanism with simple construction, easy production and convenient operation.

DETAILED DESCRIPTION

Figures 1, 4, 5:
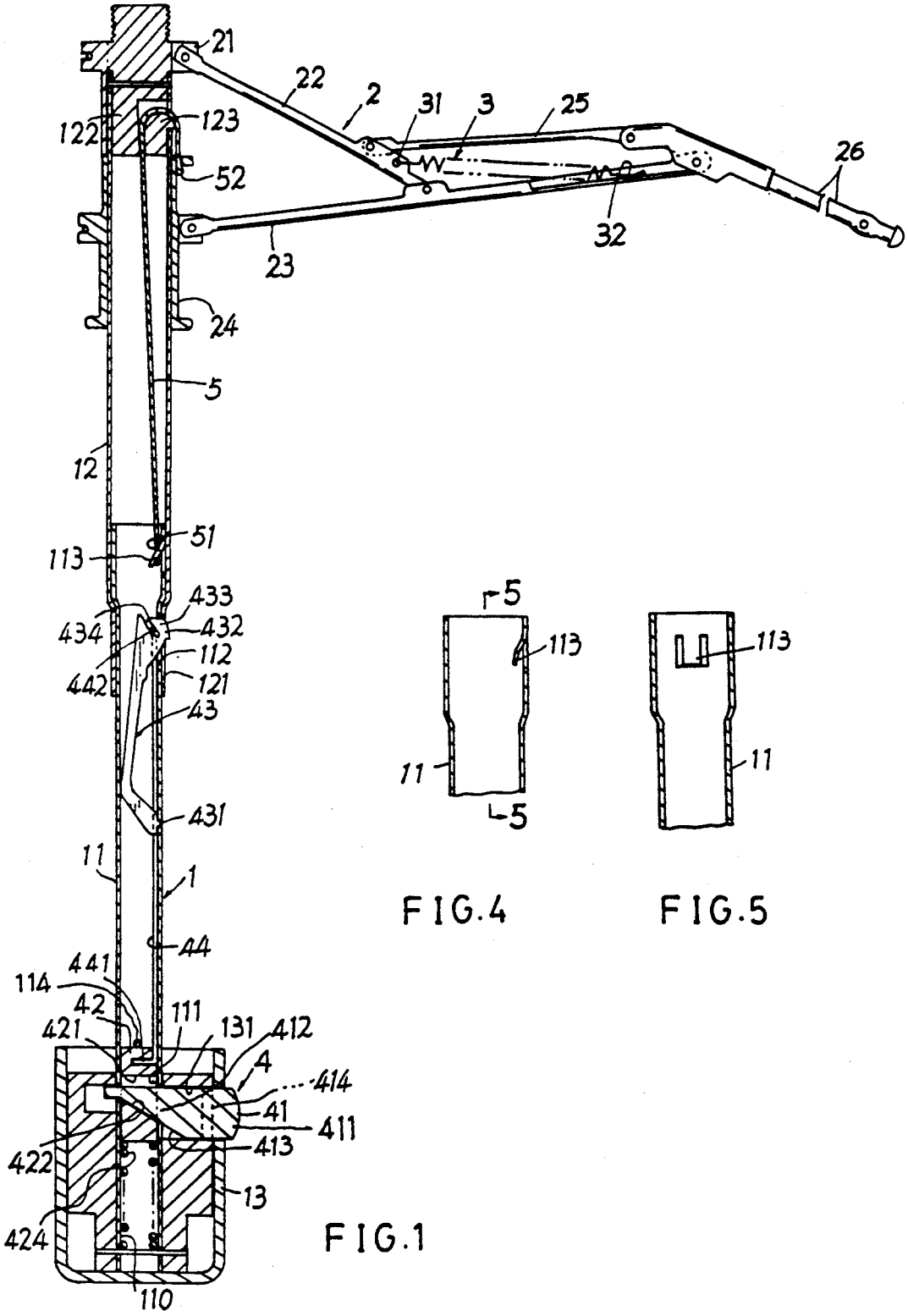
FIG. 1 is an illustration showing an opened umbrella of the present invention.
FIG. 4 is a partial sectional drawing of an upper portion of a lower tube of the present invention.
FIG. 5 is a partial longitudinal sectional drawing of the lower tube when viewed from 5—5 direction of FIG. 4.

As shown in the drawing figures, the present invention comprises: a central shaft means 1, a rib assembly means 2, a plurality of rib restoring springs 3, a control means 4 and a rope 5.

The central shaft means 1 includes: a lower tube 11 having a lower tube portion 110 of the lower tube 11 secured in a grip 13, and an upper tube 12 telescopically mounted on the lower tube 11.

The rib assembly means 2 includes: a plurality of top ribs 22 each top rib 22 having its inner end portion pivotally secured to an upper notch 21 formed on an upper portion of the upper tube 12, a plurality of stretcher ribs 23 each stretcher rib 23 having its inner end portion pivotally secured to a lower runner 24 slidably held on the central shaft means 1, a plurality of connecting ribs 25 each connecting rib 25 having its inner end portion pivotally secured to an outer end portion of each top rib 22, and a plurality of outer ribs 26 each outer rib 26 having its innermost end portion pivotally secured to an outer end portion of each connecting rib 25 and having an inner end portion of each outer rib 26 pivotally secured to an outer end portion of each stretcher rib 23. Each top rib 22 has its outermost end portion pivotally secured with a middle portion of each stretcher rib 23. The structure of the rib assembly means 2 is not limited in this invention.

Each rib restoring spring 3 has an inner spring end 31 secured to an outer portion of each top rib 22 between a first pivotal joint of the top rib 22 with the connecting rib 25 and a second pivotal joint of the top rib 22 with the stretcher rib 23: and an outer spring end 32 secured to an outer end portion of the stretcher rib 23 adjacent to a pivotal joint of the stretcher rib 23 with the outer rib 26. However, the location and quantity of the springs 3 are not limited in this invention. For reducing the cost, the number of the springs 3 may be less than the number of the ribs 2, depending upon a spring force enough for retracting the umbrella when closing the same.

The rope 5 is flexible having a lower rope end 51 secured to a hook portion 113 formed on an upper portion of the lower tube 11, and an upper rope end 52 secured to the lower runner 24 of the rib assembly means 2 by winding the rope along an arcuate groove 123 (which may also be modified to be a roller (not shown) pivotally mounted on the upper tube 12) formed in an inner block 122 formed on an upper portion of the upper tube 12. The rope 5 tensioned between the lower tube 11 and the runner 24 and the upper tube 12 will help a smooth umbrella opening and closing operation in this invention and will be explained hereinafter.

Figure 6A:
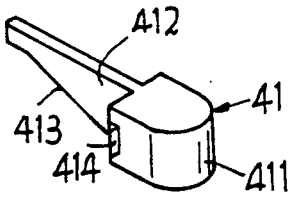
FIG. 6*a* shows another preferred push button of the present invention.
Figure 8:
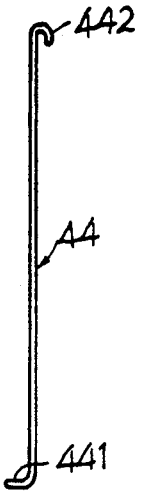
FIG. 8 shows a pulling rod of the present invention.
Figure 7:
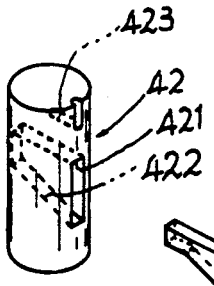
FIG. 7 is a perspective view of a closing actuator of the present invention.
Figure 6:
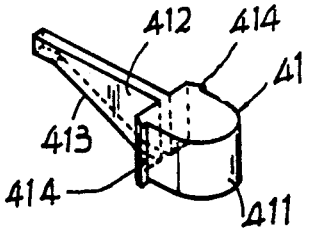
FIG. 6 is a perspective view of a push button of the present invention.

The control means 4 includes: a push button 41 having a button portion 411 normally protruding outwardly beyond the grip 13, a wedge portion 412 protruding inwardly from the button portion 411 to be slidably held in a button hole 131 formed in the grip 12 and in a lower hole 111 formed in a lower portion of the lower tube 11, having a sloping surface 413 formed on a bottom portion of the wedge portion 412 inclined downwardly outwardly towards the button portion 411, and a button shoulder portion 414 formed on the button portion 411 for limiting the push button 41 in the button hole 131 within an inside wall of the grip 13 (the shoulder portion 414 may also be simplified to be a stopper 414 as shown in FIG. 6*a*); a closing actuator 42, generally cylindrical shaped resiliently retained on an actuator tensioning spring 424 inserted in a lower portion 110 of the lower tube 11, which includes a wedge hole 421 transversely formed in the actuator 42 slidably engageable with the wedge portion 412 of the push button 41 having a sloping bottom wall 422 formed inside the wedge hole 421 slidably engageable with the bottom surface 413 of the push button 41, the actuator 42 normally urged upwardly by the actuator tensioning spring 424 to allow the sloping bottom wall 422 slidably thrusting the wedge portion 412 of the push button 41 transversely outwardly to protrude the push button 41 outwardly beyond the grip 13 ready for a depression operation on the push button 41, and a retainer pin 114 secured in the lower tube 11 for limiting the actuator 42 when urged by the spring 424; a resilient latch 43 generally formed as an elongate spring plate having a locking pin 431 formed on a lower portion of the latch 43 fixed in an inside wall of the lower tube 11, a cam portion 432 formed on an upper portion of the latch 43 normally resiliently protruding outwardly for engaging an upper latch hole 112 formed in an upper portion of the lower tube 11 and a lower latch hole 121 formed in a lower portion of the upper tube 12 when opening the umbrella as shown in FIG. 1, a platform portion 433 formed on an upper edge portion of the cam portion 432 and engageable with the latch holes 112, 121 of the lower and upper tubes for retaining the upper tube 12 to be positioned above the lower tube 11, and a tilting slot 434 formed in the cam portion 432 and inclined downwardly outwardly towards an inside wall of the lower tube 11; and a pulling rod 44 having a lower rod end 441 inserted in a rod hole 423 formed in an upper portion of the closing actuator 42 and an upper rod end 442 formed as a pulling hook member 442 slidably engageable with the tilting slot 434.

The push button 41 is operatively depressed inwardly to force the closing actuator 42 downwardly to allow the pulling hook member 442 formed on the upper end portion of the pulling rod 44 to thrust the tilting slot 434 of the cam portion 432 inwardly to retract the cam portion 432 for uncoupling the upper tube 12 from the lower tube 11 for folding the rib assembly means 2 and for retracting the upper and lower tubes for closing an opened umbrella when restored by the rib restoring springs 3.

When using the present invention, the grip 13 is grasped by a user's hand and the runner 24 is raised upwardly by the user's another hand for extending the ribs 2 and pulling the upper tube 12 upwardly until the platform portion 433 of the cam portion 432 engaging the latch holes 121, 112 of the two tubes 12, 11 for retarding the upper tube 12 to be positioned above the lower tube 11.

When the umbrella is opened, the rib restoring springs 3 are tensioned to store their spring restoring energy to have a tendency to retract the ribs 2, to lower the runner 24 and to pull the lower tube 11 towards the upper tube 12 for closing the umbrella. However, the cam portion 432 engages with the latch holes 121, 112 formed in the two tubes 12, 11 for preventing a retraction of the two tubes 12, 11 even under the spring force restored by the rib springs 3, thereby ensuring a stable opening state of the umbrella.

Figure 3:
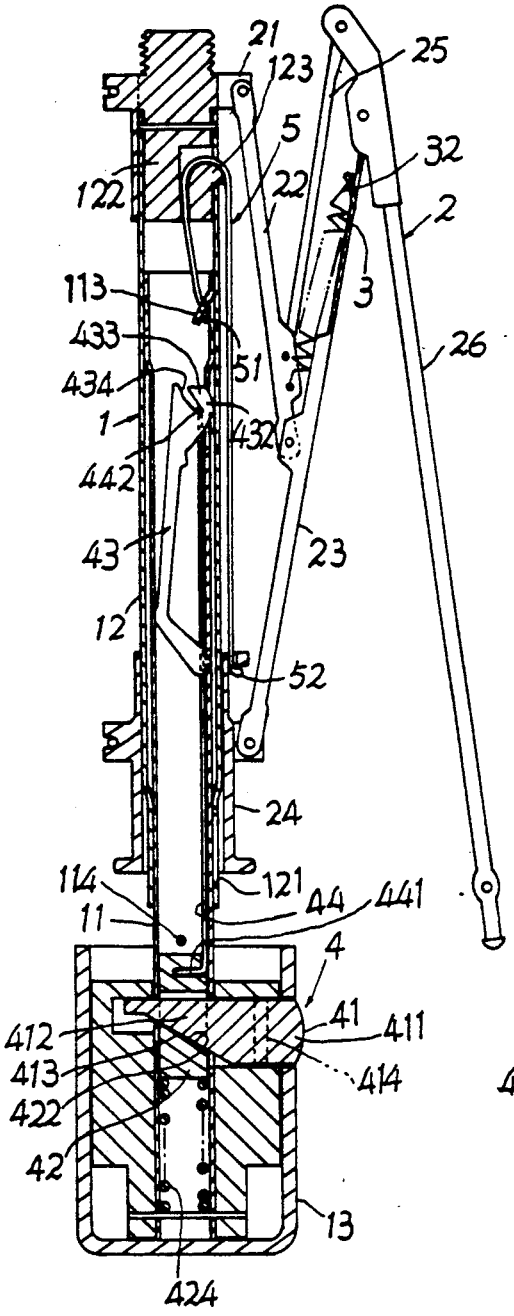
FIG. 3 shows a folded umbrella of the present invention.
Figure 2:
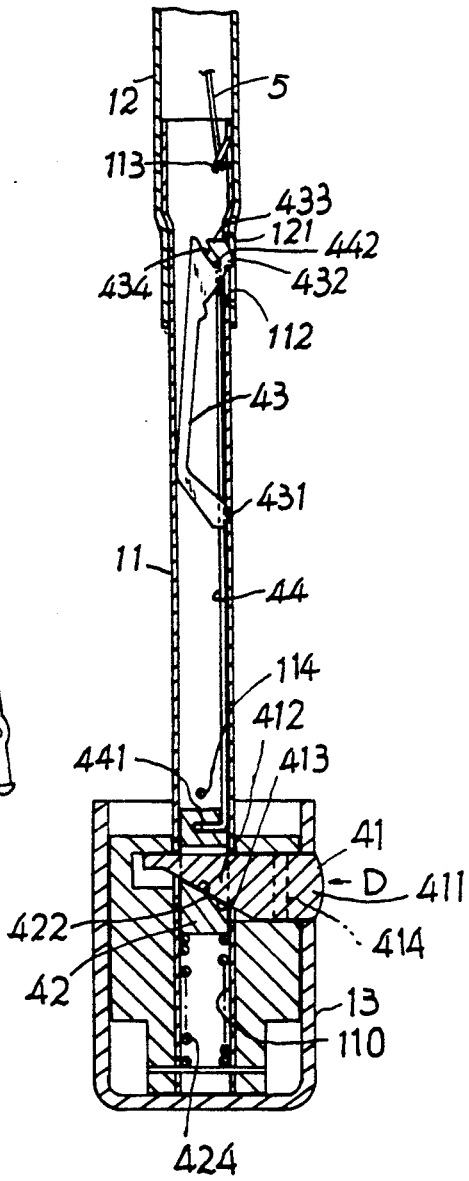
FIG. 2 shows an initial step for closing the umbrella of the present invention.

When closing the umbrella, the push button 41 is depressed inwardly to allow the sloping surface 413 of the wedge portion 412 for thrusting the sloping bottom wall 422 for depressing the actuator 42 downwardly to pull the pulling rod 44 downwardly. The upper hook member 442 of the pulling rod 44 will thrust the slot 434 of the cam portion 432 downwardly to retract the cam portion 432 for uncoupling the upper tube 12 from the lower tube 11. The rib springs 3 will restore to retract the ribs 2 and lower the runner 24 downwardly to pull the rope 5 of which the lower rope end 51 is secured to the lower tube 11 to relatively retract the upper tube 12 towards the lower tube 11 from FIG. 1 to FIG. 3 for closing the umbrella.

The present invention has the following advantages superior to a conventional umbrella having automatic closing mechanism:

1. The automatic closing mechanism is quite simple for an easy production, lower cost and better commercial promotion.

2. The elements and parts are decreased to reduce the total weight of a complete umbrella for a convenient carrying.

3. The rope 5 can help a smooth operation either for opening and closing the umbrella.

4. An ergonomic design factor has been considered to thereby provide an umbrella which can be closed automatically with a smooth, reasonable and force-saving operation.

5. The number of rib springs 3 can be reduced to thereby decrease the production cost of this invention.

I claim:

1. An umbrella comprising: a central shaft means having a lower tube secured on a grip and an upper tube telescopically mounted on the lower tube, a rib assembly means having a plurality of umbrella ribs pivotally secured to the central shaft means for securing an umbrella cloth thereon, a plurality of rib restoring springs respectively secured on the ribs for operatively automatically closing the umbrella, which is previously opened to tension the rib restoring springs for storing their restoring spring energy a lower runner slidably mounted on said central shaft and connected to said rib assembly, a control means having a push button transversely slidably held in the grip and a closing actuator vertically slidably held in the lower tube having a pulling rod linked to a resilient latch for operatively retracting the resilient latch for uncoupling the upper tube from the lower tube when closing the umbrella, and a rope secured between the lower tube and a lower runner of the umbrella ribs by slidably feeding in and pulling out the rope in an upper portion of the upper tube to be operatively tensioned on the rope when opening the umbrella to have a tendency for pulling the lower runner of the umbrella ribs and the upper tube towards the lower tube as restored by the rib restoring springs for closing the umbrella automatically when depressing the push button.

2. An umbrella according to claim 1, wherein each said rib restoring spring has an inner spring end secured to an outer portion of a top rib of said rib assembly means and an outer spring end secured to an outer end portion of a stretcher rib pivotally secured with the top rib.

3. An umbrella according to claim 1, whrein said rope is flexible having a lower rope end secured to a hook portion formed on an upper portion of the lower tube, and an upper rope end secured to a lower runner of the rib assembly means by pulling the rope over and along an arcuate groove formed on an upper portion of the upper tube.

4. An umbrella according to claim 1, wherein said control means includes: said push button having a button portion normally protruding outwardly beyond the grip, a wedge portion protruding inwardly from the button portion to be slidably held in a button hole formed in the grip and in a lower hole formed in a lower portion of the lower tube, having a sloping surface formed on a bottom portion of the wedge portion inclined downwardly outwardly towards the button portion, and a button shoulder portion formed on the button portion for limiting the push button in the button hole within an inside wall of the grip;

a closing actuator, generally cylindrical shaped resiliently retained on an actuator tensioning spring inserted in a lower portion of the lower tube, including: a wedge hole transversely formed in the actuator slidable engageable with the wedge portion of the push button having a sloping bottom wall formed inside the wedge hole slidably engageable with the bottom surface of the push button;

a resilient latch generally formed as an elongate spring plate having a locking pin formed on a lower portion of the latch fixed in an inside wall of the lower tube, a cam portion formed on an upper portion of the latch normally resiliently protruding outwardly for engaging an upper latch hole formed in an upper portion of the lower tube and a lower latch hole formed in a lower portion of the upper tube when opening the umbrella, a platform portion formed on an upper edge portion of the cam portion and engageable with the latch holes of the lower and upper tubes for retaining the upper tube to be positioned above the lower tube, and a tilting slot formed in the cam portion and inclined downwardly outwardly towards an inside wall of the lower tube; and a pulling rod having a lower rod end inserted in a rod hole formed in an upper portion of the closing actuator and an upper rod end formed as a pulling hook member slidably engageable with the tilting slot;

said push button being operatively depressed inwardly to force the closing actuator downwardly to allow the pulling hook member formed on the upper end portion of the pulling rod to thrust the tilting slot of the cam portion inwardly to retract the cam portion for uncoupling the upper tube from the lower tube for folding the rib assembly means and for retracting the upper and lower tubes for closing an opened umbrella when restored by the rib restoring springs.

* * * * *